US010477929B2

(12) United States Patent
Lin

(10) Patent No.: US 10,477,929 B2
(45) Date of Patent: Nov. 19, 2019

(54) MODULAR ACCESSORY APPARATUS

(71) Applicant: Regal Jewelry Manufacture Co., Ltd., Samutsakorn (TH)

(72) Inventor: Ju-Ying Lin, Taipei (TW)

(73) Assignee: REGAL JEWELRY MANUFACTURE CO., LTD, Samutsakorn (TH)

( * ) Notice: Subject to any disclaimer, the term of this patent is extended or adjusted under 35 U.S.C. 154(b) by 0 days.

(21) Appl. No.: 15/895,817

(22) Filed: Feb. 13, 2018

(65) Prior Publication Data

US 2019/0246753 A1 Aug. 15, 2019

(51) Int. Cl.

| | |
|---|---|
| ***A44C 13/00*** | (2006.01) |
| ***A44C 15/00*** | (2006.01) |
| ***A44C 5/12*** | (2006.01) |

(52) U.S. Cl.

CPC ..... *A44C 13/00* (2013.01); *A44C 5/12* (2013.01); *A44C 15/003* (2013.01)

(58) Field of Classification Search

CPC ..... A44C 5/0084; A44C 5/12; A44C 13/00; A44C 7/002; A44C 7/003; A44C 15/0035

See application file for complete search history.

(56) References Cited

U.S. PATENT DOCUMENTS 4,630,452 A * 12/1986 Connelly ..... A44C 7/003 24/108
9,066,562 B2 * 6/2015 Azar ..... A44C 5/12
9,392,849 B1 * 7/2016 Makhoulian ..... A44C 7/003

FOREIGN PATENT DOCUMENTS

FR 2577394 A1 * 8/1986 ..... A44C 5/20

* cited by examiner

*Primary Examiner* — Abigail E Troy

(74) *Attorney, Agent, or Firm* — Patterson + Sheridan, LLP

(57) ABSTRACT

A modular accessory apparatus includes a body component and a housing component. The body component has a first end and a second end, wherein the body component has a curvature such that a cap forms between the first end and the second end along the direction of extension of the curvature, and the first end has a connector. The housing component modularly couples to the connector. The housing component has a housing body, a coupler component, and a gateway block. The housing body has an opening, and the coupler component is disposed in the housing body. The gateway block is disposed in the opening, wherein the gateway block has a through-hole corresponding to the coupler component. The coupler component receives the connector via the through-hole, and the through-hole of the gateway block limits the displacement movement of the connector along a coplanar direction to the direction through the through-hole.

9 Claims, 6 Drawing Sheets

MODULAR ACCESSORY APPARATUS

BACKGROUND

1. Technical Field

The present disclosure generally relates to a modular accessory apparatus; particularly, the present disclosure relates to a modular accessory apparatus that can be selectively assembled together from a plurality of modular components.

2. Description of the Related Art

As the market for jewelry accessories increases, competition between companies to provide jewelry accessories that are both innovative and functional in design also correspondingly increases. However, one major flaw with hard accessories such as necklaces or bracelets is that they are hard to put on and take off without significant struggle as the components are not adjustable to accommodate different sizes of different users. For instance, a silver bracelet may not be flexible enough to allow users to put it on and take it off with ease while also ensuring close fit after putting it on. At the same time, accessories are a fashion statement and therefore need to show good design. Correspondingly, there is a need for a new modular design to simplify and lessen this difficulty for the customer.

SUMMARY

It is an objective of the present disclosure to provide a modular accessory apparatus that allows for interchangeable modular components to selectively adjust for size and design changes.

According to one aspect of the invention, a modular accessory apparatus is provided. The modular accessory apparatus includes a body component and a housing component. The body component has a first end and a second end, wherein the body component has a curvature such that a cap forms between the first end and the second end along the direction of extension of the curvature, and the first end has a connector. The housing component modularly couples to the connector. The housing component has a housing body, a coupler component, and a gateway block. The housing body has an opening, and the coupler component is disposed in the housing body. The gateway block is disposed in the opening, wherein the gateway block has a through-hole corresponding to the coupler component. The coupler component receives the connector via the through-hole, and the through-hole of the gateway block limits the displacement movement of the connector along a coplanar direction to the direction through the through-hole.

DETAILED DESCRIPTION OF THE PREFERRED EMBODIMENT

Embodiments of the present invention provide a modular accessory apparatus. In the following detailed description, references are made to the accompanying drawings that form a part hereof, and in which are shown by way of illustration specific embodiments or examples. These embodiments are only illustrative of the scope of the present invention, and should not be construed as a restriction on the present invention. Referring now the drawings, in which like numerals represent like elements through the several figures, aspects of the present invention and the exemplary operating environment will be described.

The present disclosure provides a modular accessory apparatus. In preferred embodiments, the accessories can include jewelry accessories such as necklaces, bracelets, pendants, and accessory chains. However, the modular accessory apparatus of the present disclosure is not limited or restricted to these applications.

Figure 1:
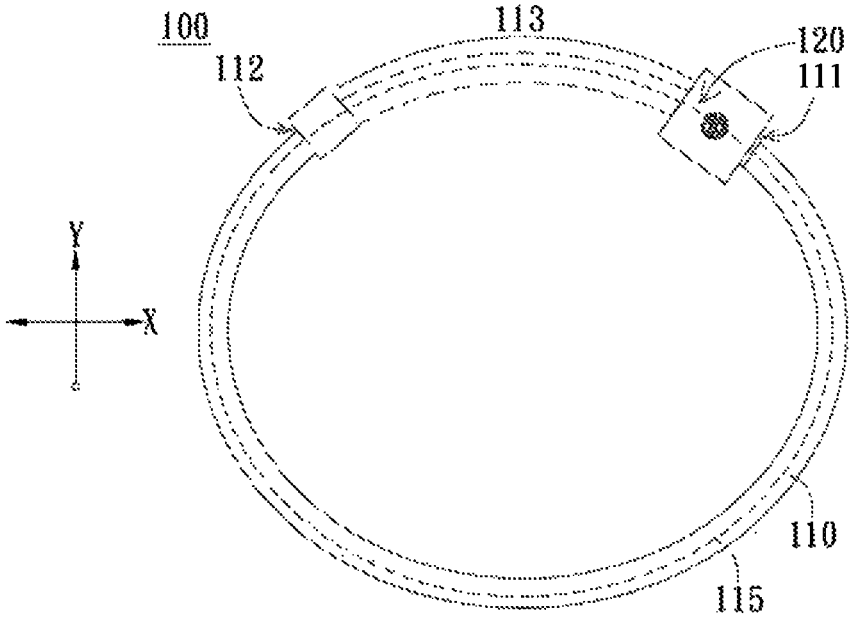
FIG. 1 is a view of an embodiment of an modular accessory apparatus of the present disclosure.

Referring to FIG. 1, an embodiment of the modular accessory apparatus 100 of the present disclosure is shown. In the present embodiment, the modular accessory apparatus 100 is illustrated as a bracelet accessory. However, it should be noted that the modular accessory apparatus 100 can also be applied towards other different accessories as a type of modular connector connecting various different components together into one design.

As illustrated in FIG. 1, the modular accessory apparatus 100 can include a body component 110 and at least one housing component 120. In the present embodiment, the modular accessory apparatus 100 is a bracelet accessory. However, the modular accessory apparatus is not restricted or limited in any way to only this form. In other different embodiments, the modular accessory apparatus can be applicable to any other fields that may benefit from the coupling mechanism taught in the present disclosure.

In the present embodiment, the modular accessory apparatus 100 is formed as a bracelet accessory. As such, the body component 110 has a curvature 115. As illustrated in FIG. 1, the body component 110 has a first end 111 and a second end 112, wherein a gap 113 is formed between the first end 111 and the second end 112. In other words, along the direction of curvature 115 of the body component 110, gap 113 is formed between the first end 111 and the second end 112 where there is no body component 110 but is still along the direction of extension of the curvature 115.

In the present embodiment, the body component 110 is formed as a non-flexible or slightly flexible structure; however, in other different embodiments, the body component 110 may be formed of a flexible structure. For instance, if the body component 110 is formed from silver, alloy metal, or jade, the body component 110 may be relatively hard in material and structure. However, if the body component 110 is formed from gold, the structure of the body component may be relatively soft and malleable.

Figure 2:
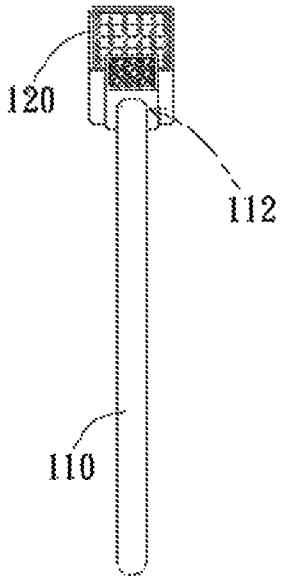
FIG. 2 is an side view of the modular accessory apparatus of FIG. 1 in the X direction.

FIG. 2 is a side view of the embodiment of FIG. 1 in the direction X from the second end 112 towards the first end 111. As illustrated in FIG. 2, a plurality of ornaments components may be disposed on a side of the housing component 120 facing generally facing the direction of the second end 112, For instance, a plurality of recesses may be formed on that side of the housing component 120, wherein a corresponding amount of crystals or diamonds may be disposed in each of those recesses. However, in other different embodiments, other different sides of the housing component 120 can be disposed with the recesses and ornament designs mentioned above.

Figure 3:
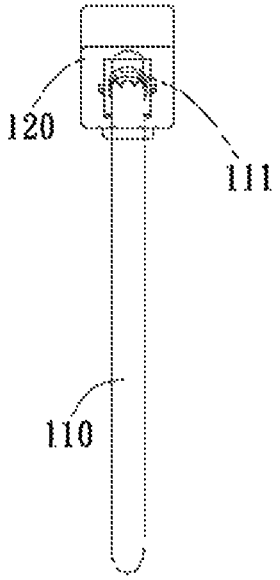
FIG. 3 is another side view of the modular accessory apparatus of FIG. 1 in the opposite direction of the X direction in FIG. 2.

FIG. 3 is a side view of the embodiment of FIG. 1 in the direction opposite to the direction X from the first end 111 towards the second end 112. In other words, the side view in FIG. 3 is viewed from the opposite direction of the view in FIG. 2. As illustrated in FIG. 3, the first end 111 of the body component 110 is coupled or connected to the housing component 120.

Figure 4:
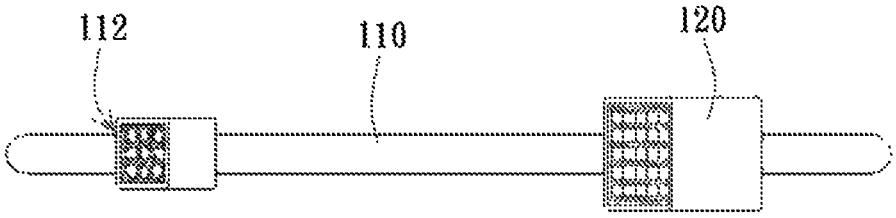
FIG. 4 is a top view of the embodiment of FIG. 1.

FIG. 4 is a top view of the embodiment of FIG. 1. In the present embodiment, other than the housing component 120 being coupled to the first end 111 of the body component 110, another housing component may be coupled to the second end 112. Similar to the housing component 120 exemplarily having a plurality of ornamental crystals or diamonds on the side facing generally in the direction of the second end 112, the housing component of the second end 112 may also have a side that has a plurality of ornamental crystals or diamonds. Furthermore, in the present embodiment, the size of the housing component 120 is greater than the size of the other housing component on the second end 112. However, in other different embodiments, they may have the same size and/or shapes.

Figure 5A:
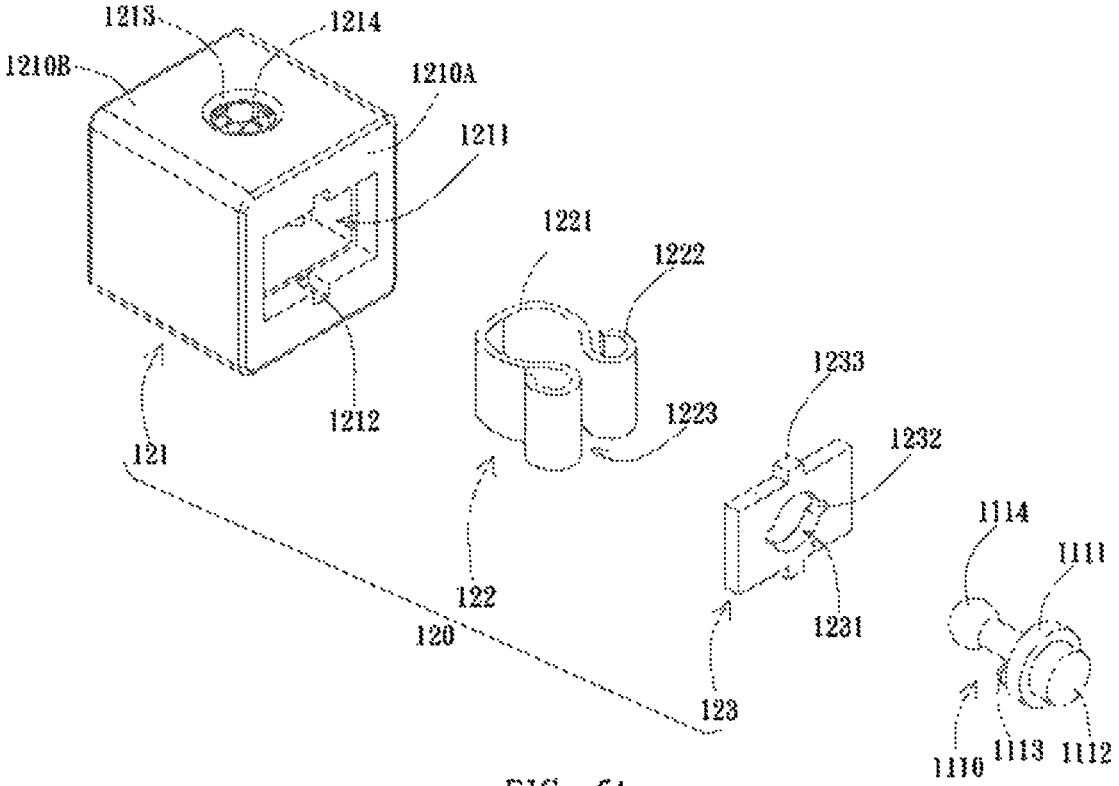
FIG. 5A is an embodiment of an housing component and a connector of the modular accessory apparatus of FIG. 1.

FIG. 5A is an embodiment of the housing component 120 and a connector 1110, wherein the connector 1110 is connected or attached to the first end 111 of the body component 110. In the present embodiment, the housing component 120 may include a housing body 121, a coupler component 122, and a gateway block 123.

In the present embodiment, the housing body 121 is shaped in a generally square shape; however, the housing body 121 is not limited to being a square shape. In other different embodiments, the housing body 121 may be shaped in any other polygonal shape or maybe even be a sphere, elliptical, or egg shape. Furthermore, the size and material of the housing body 121 can be adjusted according to design requirements.

As shown in FIG. 5A, the housing body 121 has an opening 1211. In the present embodiment, the opening 1211 is formed on a side 1210A that opens into a cavity or accommodating space inside the housing body 121. In addition, the housing body 121 can further include at least one recess 1213 formed on a surface of a side 1210B adjacent to the side 1210A having the opening 1211, wherein the recess 1213 accommodates an ornament object 1214.

Figure 5B:
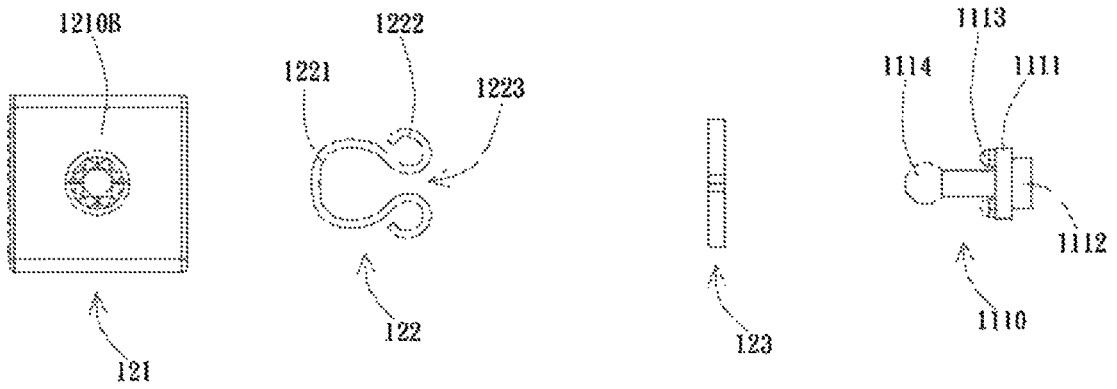
FIG. 5B is a top view of the embodiment of FIG. 5A.

In the present embodiment, the coupler component 122 is disposed in the accommodating space or cavity in the housing body 121 that opens to the opening 1211. As illustrated in FIG. 5A and FIG. 5B (top view of FIG. 5A), the coupler component 122 is formed substantially in the shape of an ohm symbol (Ʊ), wherein the coupler component 122 has a coupler base 1221 and two guidance components 1222 respectively connected to the coupler base 1221. A coupler opening 1223 is formed between the two guidance components 1222, wherein the coupler opening 1223 corresponds to the opening 1211 and a through-hole of a gateway block 123.

In the present embodiment, the coupler base 1221 of the coupler component 122 provides flexibility and tension to the two guidance components 1222 such that the two guidance components 1222 can flex away from each other (which subsequently enlarges the coupler opening 1223 between the two guidance components 1222) and/or have enough spring tension to revert back into position with respect to each other such that the coupler opening 1223 returns to it default arrangement. In one embodiment, the coupler component 122 is formed of a metallic material; however, in other different embodiments, to save weight, the coupler component 122 may also be formed from plastics or any other suitable materials.

Referring again to FIG. 5A, the housing component 120 includes the gateway block 123. In the present embodiment, the gateway block 123 is disposed at the opening 1211 of the housing body 121. In other words, the gateway block 123 covers the coupler component 122 when disposed at the opening 1211. In this manner, the gateway block 123 limits or restricts the coupler component 122 from moving out of the housing body 121 via the opening 1211. In the present embodiment, the gateway block 123 is formed from a metallic material; however, the gateway block 123 is not limited to being formed from a metallic material. In other different embodiments, the gateway block 123 may be formed from plastic or any other suitable material. In addition, as shown in FIGS. 5A and 5B, the gateway block 123 is preferably formed as a plate structure, wherein the overall shape and/or size of the plate structure of the gateway block 123 may be adjusted to correspond to the shape/size of the opening 1211 of the housing body 121. However, it should be noted that if the shape of the housing body 121 were to be a spherical shape or any other non-quadrilateral shape, the gateway block 123 may correspond to any shape of the opening 1211 or extension of shape of the housing body 121 at the opening 1211. In other words, for instance, if the housing body 121 is generally formed as a three-dimensional triangle and the opening 1211 is formed at one of the corners of three-dimensional triangle such that one of the three vertices of the three-dimensional triangle is cut off, the gateway block 123 can be formed as the cut off corner. In this manner, when the gateway block 123 is disposed at the opening 1211 of the housing body 121, the gateway block 123 will substantially complete the general three-dimensional triangle shape of the housing body 121.

In the present embodiment, the gateway block 123 has a through-hole 1231 corresponding to the coupler component 122. As illustrated in FIGS. 5A and 5B, the coupler component 122 is disposed in the housing body 121 such that the coupler opening 1223 is facing the opening 1211 of the housing body 121. At the same time, since the gateway block 123 is disposed at the opening 1211, the through-hole 1231 of the gateway block 123 would naturally be positioned in front and corresponding to the coupler opening 1223 of the coupler component 122.

As illustrated in FIGS. 1, 5A and 5B, connector 1110 may be connected to the first end 111 of the body component 110. In the present embodiment, the connector 1110 includes a connector body 1111, a connector base 1112, and a connector head 1114. The connector body 1111 is formed in a plate structure, wherein the general shape of the plate structure is a flat cylinder. However, the connector body 1111 is not limited to this shape. In other different embodiments, the shape of the connector body 1111 can be adjusted to correspond to the shape of the cross-section perpendicular to the direction of extension of the body component 110.

For instance, in the present embodiment, the body component 110 is formed as a rod shape that is curved along the curvature 115. Subsequently, the cross-section of the body component 110 that is perpendicular to the direction of curvature 115 would have a circular shape. Accordingly, in order to attach or connect the connector 1110 to the first end 111 of the body component 110, the connector body 1111 would have a cross-sectional shape that corresponds to the circular cross-sectional shape of the body component 110.

In other different embodiments, if the component 110 had other different cross-sectional shapes, the cross-sectional shape of the connector body 1111 of the connector 1110 can be adjusted corresponding to those other shapes. For instance, if the cross-sectional shape at the first end 111 of the body component 110 is of a star shape, the cross-sectional shape of the connector body 1111 can also correspondingly have the same star shape. In this manner, the connector 1110 can be assembled with the body component 110 such that at the shape/design of the body component 110 continues smoothly across the interface between the body component 110 and the connector 1110.

As shown in FIGS. 5A and 5B, in the present embodiment, the connector body 1111 is formed as a flat cylinder having a top surface and a bottom surface, wherein the top surface and the bottom surface corresponds to the flat surfaces of the flat cylinder shape of the connector body 1111. On the bottom surface of the connector body 1111 facing the first end 111 of the body component 110, the connector base 1112 is formed extending from the bottom surface. In the present embodiment, the connector base 1112 is formed in a cylinder shape. The body component 110 may have a hollow core such that the connector base 1112 of the connector 1110 can plug into the hollow core at the first end 111 of the body component 110. However, in other different embodiments, the body component 110 may have a solid core, wherein a recess is formed at the first end 111 such that the connector base 1112 of the connector 1110 can plug into the recess.

In addition, the guidance components 1222 is formed from curling back away from the coupler opening 1223 such that the surfaces of the two guidance components 1222 in the proximity of the coupler opening 1223 is a smooth curved surface.

As illustrated in FIGS. 5A and 5B, the connector 1110 includes connector head 1114, wherein the connector head 1114 is formed extending from the surface on the connector body 1111 opposite to the connector base 1112. In other words, the connector head 1114 is formed on the surface of the connector body 1111 facing away from the connector base 1112. In the present embodiment, at the end of the extension of the connector head 1114 away from the connector body 1111, the connector head 1114 can be formed as a spherical shape; however, the connector head 1114 is not restricted or limited to being formed as a spherical shape. In other different embodiments, the connector head 1114 can be formed as any other polygonal shape.

In the present embodiment, when the coupler component 122 is disposed in the housing body and the gateway block 123 is disposed in the opening 1211, the connector 1110 can at least be partially inserted into the coupler opening 1223 between the two guidance components 1222 via the through-hole 1231 of the gateway block 123. As the connector 1110 of the body component 110 is inserted into the coupler opening 1223 through the through-hole 1231, the connector head 1114 will be received by the two guidance components 1222.

Just before the connector head 1114 is received by the two guidance components 1222, the width of the coupler opening 1223 will be smaller than the diameter of the horizontal cross-section of the connector head 1114. As the connector 1114 is received by the two guidance components 1222, the connector hear 1114 will push against the curved surfaces of the two guidance components 1222 and cause the two guidance components 1222 to be pulled farther apart from each other. In other words, the coupler opening 1223 will widen to accept the connector head 1114.

In the present embodiment, the coupler base 1221 will provide tension or spring effect for the two guidance components 1222 such that the two guidance components 1222 will in conjunction apply a pinching force on the connector head 1114. In this manner, the coupler component 122 can securely hold or retain the connector head 1114 between the two guidance components 1222 and prevent the connector 1110 from detaching out of the housing body 121 without significant force (to break out of the hold or pinching effect of the two guidance components 1222).

In other different embodiments, the connector head 1114 can end up in the accommodating space in the coupler component 122 after passing through between the two guidance components 1222. In other words, the spherical shape of the connector head 1114 can end up in the accommodating space or cavity formed by the coupler base 1221 and the two guidance components 1222, wherein the pole-like structure of the connector head 1114 that connects the spherical shaped portion to the connector body 1111 will rest between the two guidance components 1222. Since the diameter of the cross-section (along the plane parallel to the gateway block 123) of the pole-like structure is smaller than the diameter of the cross-section (along the plane parallel to the gateway block 123) of the spherical shaped portion, the guidance components 1222 will be able to revert back to their default positioning due to the tension provided by the coupler base 1221. In effect, the guidance components 1222 will then act as a lock that will prevent the connector head 1114 from leaving the cavity formed by the coupler base 1221 and the two guidance components 1222. In other words, the connector 1110 will be securely held in the cavity, and the connector 1110 can be effectively coupled or tightly connected/attached to the housing body 121.

In the present embodiment, when the connector head 1114 is inserted into the housing body 121, the gateway block 123 will engage with the connector body 1111 and limit the connector head 1114 from being inserted further into the housing body 121. In other words, the through-hole 1231 is smaller than the top surface of the connector body 1111, but big enough for the connector head 1114 to pass through. The longitudinal length of the entire connector head 1114 can be adjusted according to design requirements.

In other different embodiments, the connector 1110 can also include at least one rotation limiting protrusion 1113 formed on the top surface of the connector body 1111 and extending in the direction away from the connector base 1112. In addition, corresponding recess(es) 1232 can be formed on the inner surface of the through-hole 1231. When the gateway block 123 engages the connector body 1111, the rotation limiting protrusion 1113 can be accommodated in the recess(es) 1232 of the gateway block 123. The recess 1232 and the rotation limiting protrusion 1113 act together to limit or restrict the connector 1110 from rotating within the through-hole 1231. In other different embodiments, the connector 1110 can have 2 or more rotation limiting protrusion 1113, strategically placed apart on the top surface of the connector body 1111, and the through-hole 1231 can have the corresponding number of recesses 1232 to accommodate the rotation limiting protrusions 1113.

In the present embodiment, the gateway block 123 can also include at least one displacement limiting protrusion 1233 that protrudes extending out from a side of the gateway block in a direction parallel to the plane of the gateway block 123. As shown in FIG. 5A, the opening 1211 on the surface 1210A of the housing body 121 can also have corresponding recesses 1212. When the gateway block 123 is disposed in the opening 1211, the displacement limiting protrusion(s) 1233 plug into or are accommodated in the recess(es) 1212. The displacement limiting protrusion(s) 1233 and the recess (es) 1212 together limit or restrict the gateway block 123 for displacing out of position in the opening 1211. In addition, during assembling, the displacement limiting protrusions(s) 1233 and the recess(es) 1212 allows for easy recognition of the correct orientation of the gateway block 123 in the opening 1211.

Figure 5C:
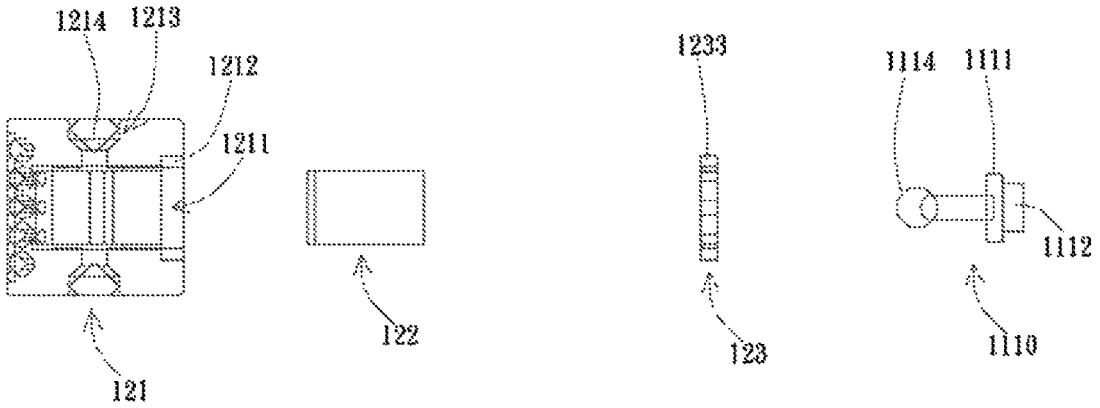
FIG. 5C is a cross-sectional view in the vertical plane cutting across the components of FIG. 5A.

As illustrated in FIGS. 5A and 5C, the housing body can further include at least one recess 1213, wherein the recess 1213 can be formed on a surface 1210B of a side adjacent to a side 1210A having the opening 1211. In the present embodiment, the recess 1213 can accommodate an ornament object 1214, wherein the ornament object 1214 can be a transparent, semi-transparent object, such as a diamond, crystal, or glass material. In other different embodiments, the recess 1213 can be coated in a reflective layer or coating that can help reflect light passing through the ornament object 1214.

Figure 6:
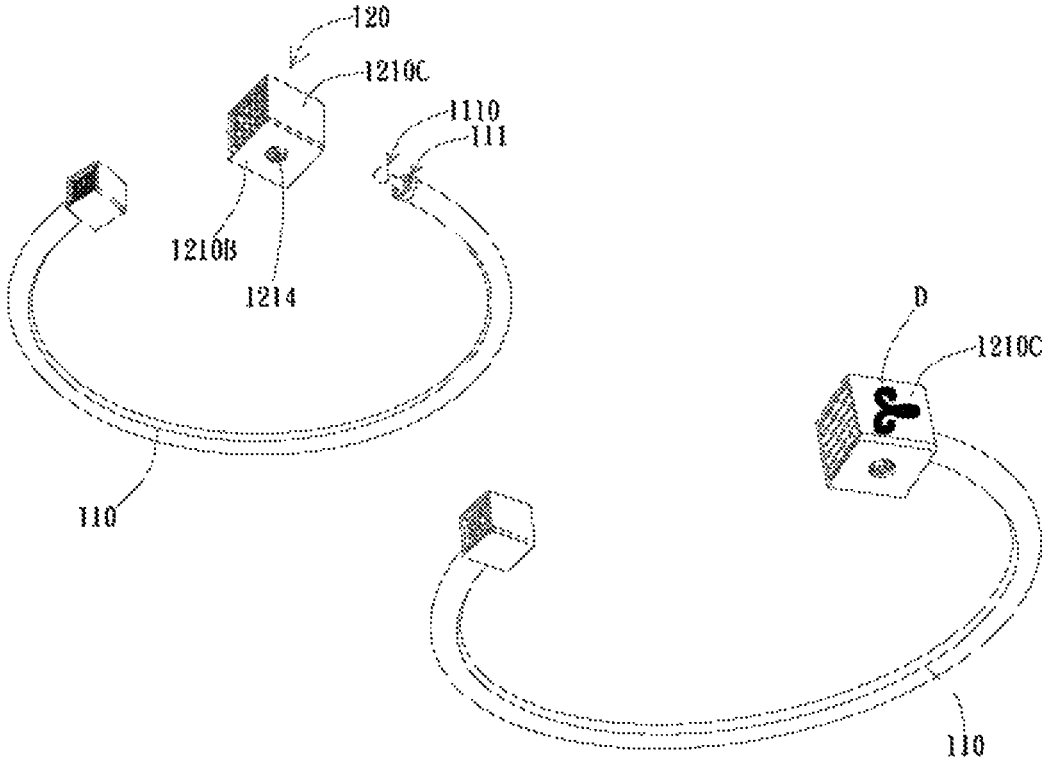
FIG. 6 is another embodiment of the modular accessory apparatus of FIG. 1.

FIG. 6 is an embodiment of FIGS. 1-5C, wherein the housing component 120 can be modularly coupled and uncoupled to the connector 1110 of the body component 110. In the present embodiment, when the body component 110 is formed as a bracelet, the body component 110 can be worn on an user's wrist before connecting the housing component 120 to the connector 1110. Since the housing component 120 has a wider cross-section (perpendicular to the direction of extension of the connector 1110 or body component 110, the housing component 120 effectively decreases the actual overall inner circumference or inner space that can accommodate the user's wrist. In other words, the user will feel a tighter fit with the bracelet. In addition, since the housing component 120 can be modularly connected and removed, different designs of the housing component 110 can be switched onto the body component 110. For instance, in the embodiment of FIG. 6, a housing component 120 without a graphic design on a surface 1210C can be exchanged for a housing component 120 with a graphic design D on the surface 1210C.

Although the embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A modular accessory apparatus, comprising:

a body component, having a first end and a second end, the body component having a curvature such that a gap forms between the first end and the second end along the direction of extension of the curvature, and the first end has a connector; and a housing component for modularly coupling to the connector, wherein the housing component comprises:

a housing body having an opening;

a coupler component disposed in the housing body; and a gateway block disposed in the opening, and the gateway block has a through-hole corresponding to the coupler component;

wherein the connector passes through the through-hole and engages with the coupler component, and the through-hole of the gateway block limits a displacement movement of the connector to the direction through the through-hole;

wherein the coupler component is formed substantially in the shape of an ohm symbol (Ʊ), wherein the coupler component has a coupler base, two guidance components respectively connected to the coupler base, and a coupler opening formed between the two guidance components; the coupler opening corresponds to the opening of the housing body and the through-hole of the gateway block.

2. The modular accessory apparatus of claim 1, wherein the coupler base provides flexibility and tension to the two guidance components such that the two guidance components can flex away from each other while receiving the connector and together securely pinch the connector as the connector enters into the coupler opening.

3. The modular accessory apparatus of claim 2, wherein the connector further comprising:

a connector body having at least two surfaces;

a connector base disposed on one of the at least two surfaces, the connector base connects with the first end of the body component;

a connector head formed extending from the other of the at least two surfaces of the connector body, the connector head is received by the two guidance components and securely pinched into position by the two guidance components.

4. The modular accessory apparatus of claim 1, wherein the gateway block further includes at least one displacement limiting protrusion, and the housing body further includes at least one recess connected to the opening along an inner surface of the housing body, wherein the at least one displacement limiting protrusion is accommodated in the at least one recess.

5. The modular accessory apparatus of claim 1, wherein the gateway block further includes at least one recess formed on an inner surface of the through-hole, and the connector further includes at least one rotation limiting protrusion, wherein the at least one rotation limiting protrusion is accommodated in the at least one recess when the connector is inserted through the through-hole.

6. The modular accessory apparatus of claim 1, wherein the housing body further includes a recess formed on a surface of a side adjacent to a side having the opening, the recess accommodates an ornament object.

7. The modular accessory apparatus of claim 6, wherein the recess is coated with a reflective layer, and the ornament object is substantially transparent.

8. The modular accessory apparatus of claim 1, wherein the connector and the body component are formed in one piece.

9. The modular accessory apparatus of claim 1, wherein the shape of the opening corresponds to the shape of the gateway block.

* * * * *